United States Patent [19]

Burdin

[11] 4,000,338

[45] Dec. 28, 1976

[54] METHOD OF COATING SMALL WORKPIECES WITH PLASTIC MATERIAL

[75] Inventor: Jacques Antoine Burdin, Ecully, France

[73] Assignee: Societe Anonyme dite Ato Chimie, Courbevoie, France

[22] Filed: July 23, 1973

[21] Appl. No.: 381,439

[30] Foreign Application Priority Data

July 26, 1972 France ..... 72.27618
May 30, 1973 France ..... 73.20470

[52] U.S. Cl. ..... 427/184; 427/185; 427/195; 427/242

[51] Int. Cl.[2] ..... B05D 3/12; B05D 1/24

[58] Field of Search ..... 117/21, DIG. 7, 20; 118/425, 57, 500 X; 198/220 A, 220 BA; 427/184, 195, 185, 242

[56] References Cited

UNITED STATES PATENTS

| | | | |
|---|---|---|---|
| 2,654,465 | 10/1953 | Sgriccia | 118/425 X |
| 2,990,807 | 7/1961 | Gerow | 118/57 X |
| 3,061,943 | 11/1962 | Bennett et al. | 427/185 |
| 3,097,958 | 7/1963 | Morris | 117/DIG. 6 |
| 3,125,208 | 3/1964 | Secanda | 198/220 A |
| 3,226,245 | 12/1965 | Dettling et al. | 427/185 |
| 3,257,116 | 6/1966 | Sharetts et al. | 118/DIG. 5 |
| 3,261,322 | 7/1966 | Becker et al. | 118/500 |
| 3,440,078 | 4/1969 | Sharetts | 427/185 |
| 3,447,660 | 6/1969 | Winans | 198/220 BA |
| 3,479,200 | 11/1969 | Estabrooks | 117/21 |
| 3,567,485 | 3/1971 | Lemelson | 427/185 |
| 3,619,231 | 11/1971 | Johnson | 117/21 |
| 3,650,798 | 3/1972 | Case et al. | 117/21 |

FOREIGN PATENTS OR APPLICATIONS

| | | | |
|---|---|---|---|
| 211,584 | 12/1956 | Australia | 117/DIG. 6 |
| 2,040,857 | 1/1971 | France | |
| 21,987 | 3/1961 | Japan | 117/21 |
| 848,904 | 11/1955 | United Kingdom | 117/21 |
| 1,163,041 | 9/1969 | United Kingdom | 185/ |

*Primary Examiner*—Ralph Husack
*Assistant Examiner*—Shrive P. Beck
*Attorney, Agent, or Firm*—Karl F. Ross; Herbert Dubno

[57] ABSTRACT

Small workpieces to be coated with plastic material are preheated and dropped onto a fluidized bed of plastic powder subjected to compound vibratory motion which causes the powder and the workpieces to move along a helical ramp onto a screen overlying the point of entry, with some of the particles fusing onto the workpiece surfaces to form a film. The remainder of the powder, on reaching the screen, drops back onto the bed as the coated workpieces move on to a receptacle. Fresh workpieces are deposited on the bed through one or more chutes traversing the screen; to prevent the rise of any particles through the chutes, a downward airflow is created therein.

2 Claims, 3 Drawing Figures

11
4
4b
12a
2
5
2
2
14
4a
12
13

6
2
3
8
7
3
9
5
14
4
4b
12
12a
4a
10

METHOD OF COATING SMALL WORKPIECES WITH PLASTIC MATERIAL

The present invention relates to a method of applying a coating of plastic, i.e. of thermoplastic or thermosetting material, to small parts by heating these parts and then introducing them into a powder bath of fluidized plastic material.

French Pat. No. 69,11,677 of the 22 Jan. 1971 describes a method of this type consisting of dropping the heated workpieces into the powder bath of fluidized plastic material and allowing them to descend by gravity, the powder which is in contact with the surface of the workpieces being transformed into a film or coating.

However, the application of a method of this type causes several difficulties, in particular as regards recovering the coated workpieces from the bottom of the bath without marring them. Moreover, when a workpiece has a concave surface located on its underside as it penetrates the powder bath, an air pocket is formed which opposes contact of the powder with the workpiece in this region. It is thus impossible to apply this method to workpieces of every shape.

The object of my present invention is to provide an improved process for the coating of mobile workpieces of various shapes in a manner avoiding the aforestated drawbacks.

In accordance with my invention, a fluidized bed of finely comminuted plastic material is vibrated with a compound oscillatory motion to propel the particles thereof along a predetermined path with entrainment of the preheated workpieces along the path by the advancing particles from a loading point to an unloading point. Such a compound motion may be produced, in a manner known per se, as the resultant of several periodic oscillatory movements along three mutually orthogonal axes.

In order to facilitate separation of the nonadhering powder particles from the coated workpieces, I prefer to guide the fluidized bed just ahead of the unloading point over a perforated supporting surface. Advantageously, for recycling the unused powder, the path ascends along a generally helicoidal ramp with the perforated surface overlying the loading point whereby the separated particles drop back to the starting area.

The oncoming workpieces, heated to a temperature sufficient to let the plastic powder fuse to their surfaces, may be deposited onto the fluidized bed at the loading point by way of one or more chutes traversing the perforated supporting surface; a descending airflow in each chute prevents the escape of particles therethrough from the loading point.

The coating material may be of thermoplastic or thermosetting character, e.g. a polyamide (such as the one known as "polyamide 11") or an epoxy resin.

Figure 1:
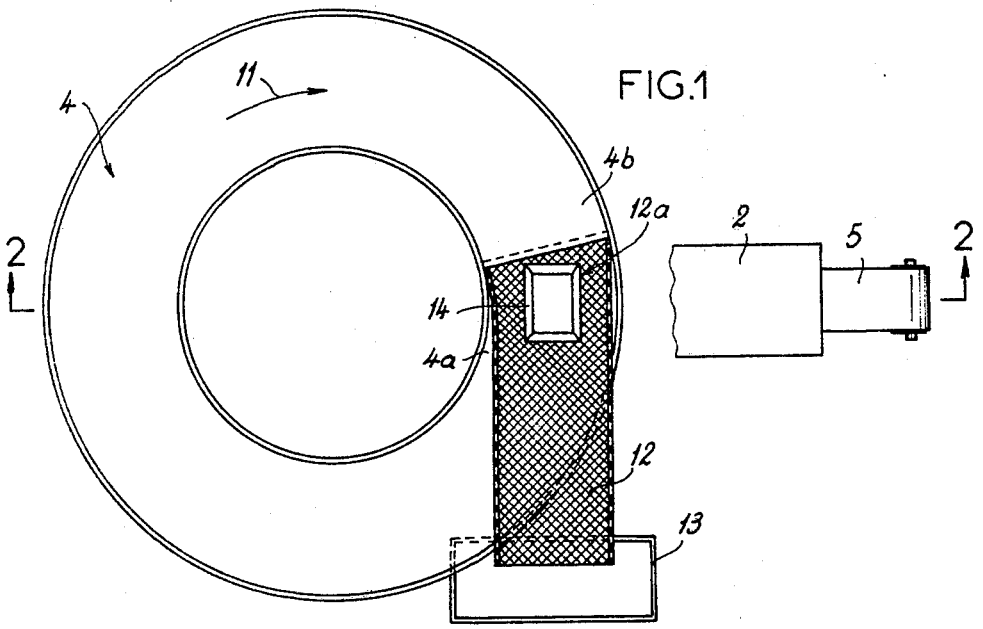
Figure 2:
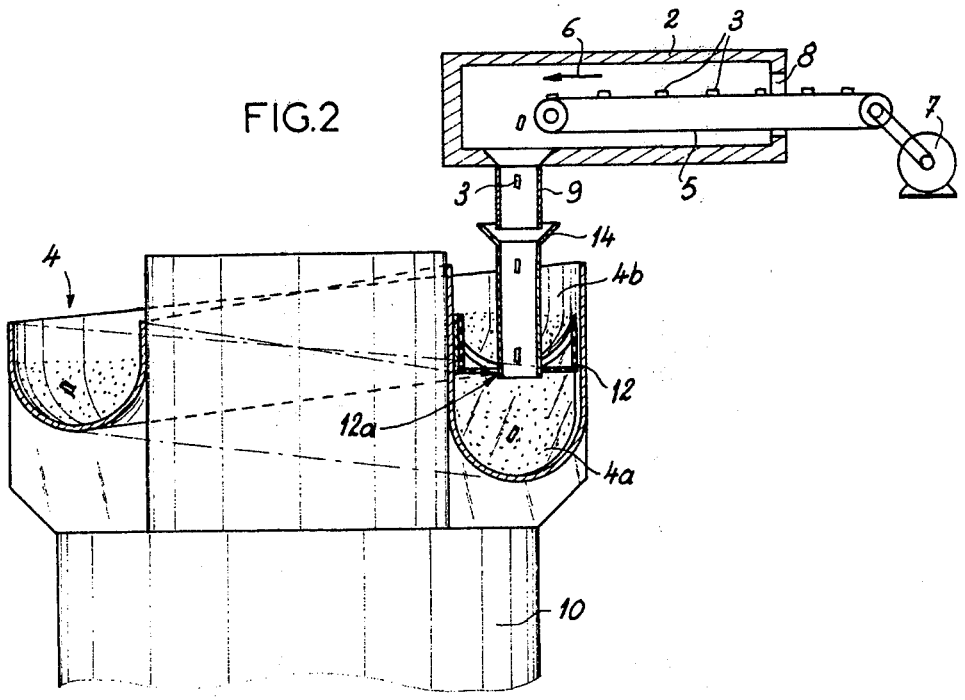
Figure 3:
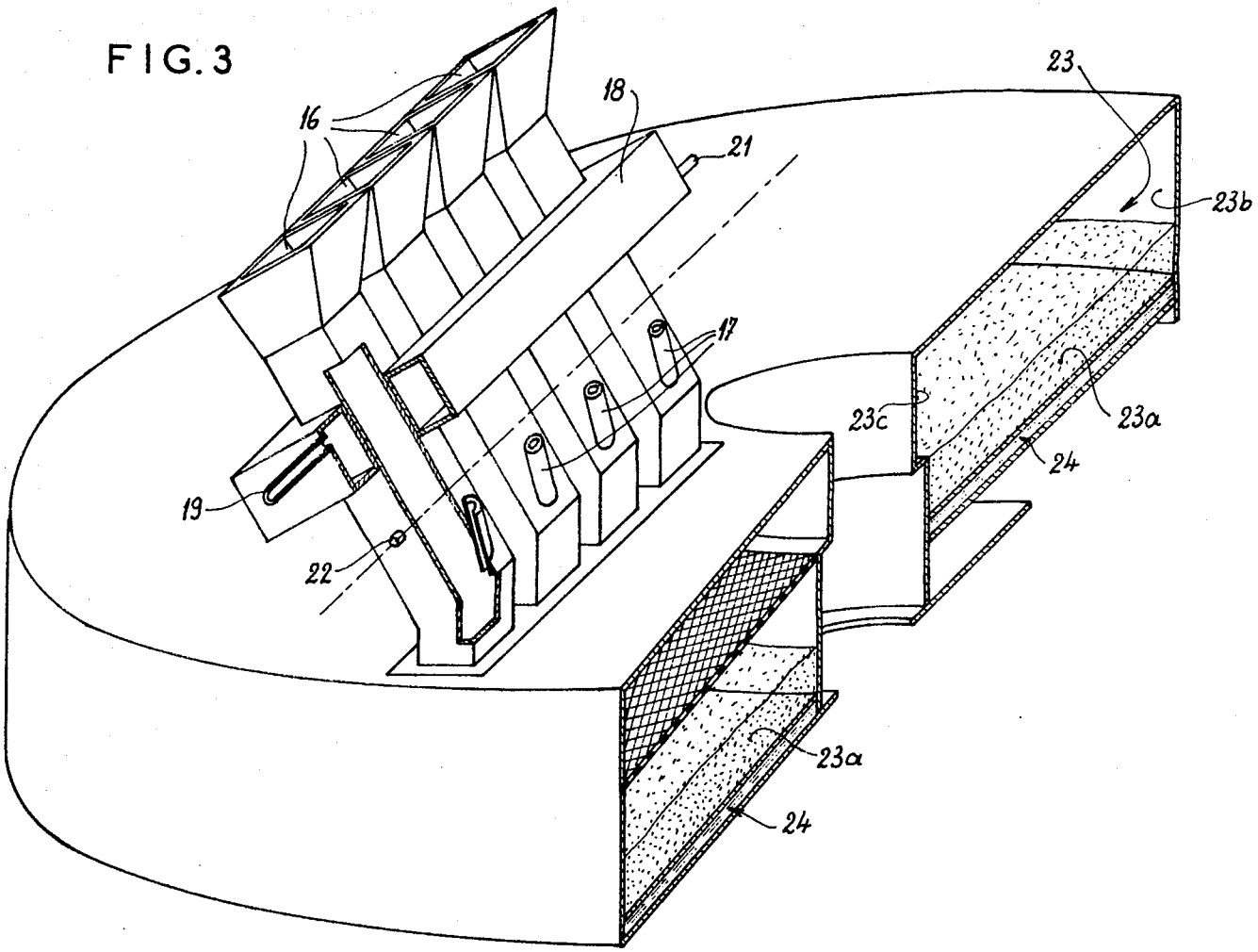

The above and other features of my invention will be described in detail hereinafter, with reference to the accompanying diagrammatic drawing, in which:

FIG. 1 is a top plan view of an apparatus for carrying out my improved coating process; endless workpieces workpieces FIG. 2 is a sectional view taken on line 2—2 of FIG. 1; and FIG. 3 is a perspective view partly in section showing various modifications of this apparatus, on an enlarged scale.

The apparatus shown in the drawing mainly comprises an oven 2 for pre-heating a series of small parts 3, representing the workpieces to be treated, and a vibrating container 4.

The oven 2 is a tunnel oven comprising an endless belt 5 driven at a constant adjustable speed in the direction of arrow 6 by the motor 7. This endless belt 5 conveys the workpieces 3 to be treated from the inlet aperture 8 of the oven 2 to an outlet aperture constituted by a vertical shaft 9 located below the downstream end of the belt 5. To facilitate loading of the workpieces 3 to be treated onto the belt 5, the upstream end of the latter is located outside the oven 2.

It should be noted that the temperature of the oven 2 is adjustable.

The container 4 filled with powdered plastic material, is constituted by a trough of semi-circular section substantially in the shape of a spiral having a vertical axis.

This trough 4 is mounted on a vibrating support 10 of known type, imparting vibrations thereto such that the powder which it contains moves at a constant speed, depending on the amplitude of the vibrations, in the direction of arrows 11. The lower end 4*a* of the trough 4 thus constitutes its inlet end or loading point and its upper end 4*b* constitutes the outlet end or unloading point thereof. Between these two points the trough forms a single turn of an ascending helicoidal ramp.

As shown in the drawing, the upper end 4*b* of the trough 4 is extended by a screen 12 whose mesh has a dimension greater than that of the grains of powder contained in the trough, but less than the minimum dimension of the parts to be treated.

This screen 12 is located partly above the end 4*a* of the trough and partly beyond this end.

This arrangement serves to facilitate, on the one hand, re-cycling of the powder from the upper end 4*b* to the lower end 4*a* of the trough and, on the other hand, the separation of the treated workpieces 3 and the re-cycled powder, these treated parts being removed at the free end of the screen 12 in order to drop into a receptacle 13.

As shown in FIG. 2, the lower end 4*a* of the trough is located below the shaft 9 constituting the outlet aperture of the oven 2. This arrangement is provided in order that the parts are introduced into the trough 4 in the region of the greatest turbulence of the comminuted plastic material, i.e. in the zone in which this powder falls from the upper end 4*b* to the lower end 4*a* of the trough 4. Consequently, in order to facilitate the passage of the workpieces to be treated through the screen 12, the latter comprises an aperture 12*a* of dimensions corresponding substantially to those of the section of the shaft 9. However, in order to avoid that the coated workpieces 3 are also recycled when they arrive at the upper end 4*b* of the trough 4, this aperture 12*a* is provided on its periphery with a funnel-shaped deflector 14, aligned with the lower end of the shaft 9. Funnel 14 terminates just below the perforated surface 12, well above the bottom of trough 4, thereby leaving a space through which the still uncoated workpieces drop freely into the fluidized bed in the trough.

This apparatus operates as follows:

The workpieces to be treated are placed on the endless belt 5 of the oven 2 in order to be preheated. At the outlet of the oven 2, they fall directly through the shaft 9, the deflector 14 and the aperture 12*a* in the screen 12 into the trough 4 at its lower end 4*a*. The vibrations imparted to the trough 4 by its support 10 displace the plastic powder which it contains, and which is to form the coating for the treated parts 3, from the lower end 4*a* to the upper end 4*b* from where it drops to the lower end 4*a* through the mesh of the screen 12. During its movement, the plastic powder carries along the preheated workpieces which are dropped into the trough 4 from the oven 2. As it is in contact with these parts, the powder forms a film whose thickness depends on the temperature of the parts and their thermal capacity as well as on the duration of travel of the parts 3 in the trough 4 and the nature of the plastic material. As it is formed, the film constitutes a thermal insulation whose outer surface is covered by superficial grains which have not melted and which may be easily removed at a later stage.

During their travel through the trough 4, the workpieces 3 are rolled in the plastic powder and the rolling effect automatically moves them into the center of the vibrated bath. Contact between the workpieces and the powder is intimate and the stirring action is continuous whatever their shape. Moreover, it should be noted that the consistency of the powder is sufficient to support the weight of the workpieces and prevents the latter from coming into contact with the walls of the trough 4.

When the parts 3 arrive at the upper end 4*b* of the trough 4, the nonadhering powder drops to the lower end 4*a* through the mesh of the screen 12. Thus, the recycled particles descend around the freshly preheated workpieces dropping from the funnel 14 while the workpieces already coated stay on the screen and are guided to its free end in order to be recovered in receptacle 13.

FIG. 3 shows certain modifications of this apparatus.

In this example, the apparatus comprises a plurality (four in this instance) of chutes 16 replacing the deflector 14 of the apparatus described with reference to FIGS. 1 and 2.

The provision of several parallel chutes 16 has the advantage of facilitating transverse staggering of the parts to be treated on the conveyor belt of the oven (not shown on this view) so that successive parts on the feeding conveyor 5 do not use the same distribution chute.

Thus, owing to a good transverse distribution of the workpieces on the conveying belt of the oven, the danger is eliminated that a workpiece following too close to the preceding workpiece might come into contact with the latter as it falls into the powder bath.

Each of the chutes 16 comprises an inlet tube 17 for a downwardly directed current of air serving to prevent the treatment powder from moving up the chute in question.

The array of chutes 16 is surrounded by a box 18 serving for the circulation of cooling water and comprising, to this end, an inlet tube 19 for cold water and a water-outlet tube 21. This cooling water prevents melting of the powder which comes into contact with the chutes.

According to another feature of the invention, the array of chutes 16 is pivotable about a horizontal shaft 22 which makes it possible to vary their inclination. In this way I am able to modify the angle at which the parts fall into the powder bath and, consequently, their penetration into that bath. It is thus possible to obtain a constant depth of penetration while treating parts of different weights.

As further shown in FIG. 3*a* vibrating container or bowl 23 containing the treatment powder has a U-shaped cross section comprising a flat base 23*a* and two vertical side walls 23*b* and 23*c*.

The rectangular shape of the section of the bowl has the advantage of preventing the formation of vortexes which would tend to retard the circulating speed of the powder bath and the treated parts and thus to increase the risk of contact between the parts below the distribution chutes.

Moreover, in order to prevent the walls of the vibrating bowl 23 from becoming heated, its base 23*a* has a double wall in order to provide a chamber 24 for the circulation of cooling water.

What I claim is:

1. A method of coating mobile workpieces with plastic material selected from the group which consists of polyamides and epoxy resins, comprising the steps of:

subjecting a fluidized bed of powdered plastic material to compound vibration and propelling said material solely by said vibration along a predetermined path from a loading point at a lower level to an unloading point at a higher level along a single turn of a generally helicoidal ascending ramp and an adjoining perforated supporting surface positioned directly above said loading point immediately ahead of said unloading point;

cooling said fluidized bed between said loading and unloading points;

preheating oncoming workpieces to a temperature at which particles of said plastic material fuse onto the surfaces thereof to form a film; and dropping freshly preheated workpieces through an aperture in said perforated surface onto said fluidized bed at said loading point for entrainment by said plastic material to said unloading point with coating of the workpieces along the way and separation of nonadhering particles from the coated workpieces at said unloading point, said nonadhering particles descending through said perforated surface onto said bed around the freshly preheated workpieces dropped through said aperture.

2. A method as defined in claim 1 wherein the workpieces are guided by a chute through said aperture and a descending airflow is generated in said chute for preventing the rise of any particles therein from said bed.

* * * * *